US008177864B1

(12) United States Patent
Bezis et al.

(10) Patent No.: US 8,177,864 B1
(45) Date of Patent: May 15, 2012

(54) FUEL AND FUEL ADDITIVE

(75) Inventors: George T. Bezis, Lindon, UT (US); Larry P. Wardle, Bountiful, UT (US); Marcus G. Theodore, Salt Lake City, UT (US)

(73) Assignee: Environmental Bio-Fuels, Inc., Bountiful, UT (US)

( * ) Notice: Subject to any disclaimer, the term of this patent is extended or adjusted under 35 U.S.C. 154(b) by 370 days.

(21) Appl. No.: 12/381,715

(22) Filed: Mar. 16, 2009

Related U.S. Application Data

(63) Continuation-in-part of application No. 12/154,348, filed on May 22, 2008, now abandoned.

(51) Int. Cl.
*C10L 10/00* (2006.01)

(52) U.S. Cl. ..... 44/307

(58) Field of Classification Search ..... 44/307
See application file for complete search history.

(56) References Cited

U.S. PATENT DOCUMENTS

| | | | |
|---|---|---|---|
| 4,347,062 | A | 8/1982 | Born et al. |
| 4,461,224 | A | 7/1984 | Michelfelder |
| 4,968,322 | A | 11/1990 | Miyawaki et al. |
| 6,096,104 | A | 8/2000 | Van den Neste et al. |
| 6,663,680 | B1 | 12/2003 | Dodd et al. |
| 6,776,606 | B2 | 8/2004 | Haskew |
| 7,300,477 | B2 | 11/2007 | Brennan et al. |

*Primary Examiner* — Jim Goloboy
(74) *Attorney, Agent, or Firm* — Marcus G. Theodore

(57) ABSTRACT

A sugar based fuel and fuel additive method and solution suitable for use with liquid as well as solid carbon based fuels to improve combustion burning or as a fuel or electrolyte for a fuel cell or battery to produce electricity.

6 Claims, No Drawings

FUEL AND FUEL ADDITIVE

RELATED PATENT APPLICATIONS

This patent application is a continuation-in-part patent application, of the patent application entitled "Fuel Additive" filed May 22, 2008 now abandoned, Ser. No. 12/154,348.

BACKGROUND OF THE INVENTION

1. Field of Invention

The present invention relates to combustion fuels. In particular, it relates to a fuel additive composition.

2. Description of Related Art

Numerous combustion fuels are known. Combustion or burning is a complex sequence of exothermic chemical reactions between a fuel and an oxidant accompanied by the production of heat or both heat and light in the form of either a glow or flames. Direct combustion by atmospheric oxygen is a reaction mediated by radical intermediates. The conditions for radical production are naturally produced by thermal runaway, where the heat generated by combustion is necessary to maintain the high temperature necessary for radical production In a complete combustion reaction, a compound reacts with an oxidizing element, such as oxygen or air, and the products are compounds of each element in the fuel with the oxidizing element. For example:

$$CH_4+2O_2 \rightarrow CO_2+2H_2O$$

In the large majority of the real world uses of combustion, the oxygen ($O_2$) oxidant is obtained from the ambient air and the resultant flue gas form the combustion will contain nitrogen:

$$CH_4+2O_2+7.52N_2 \rightarrow CO_2+2H_2O+7.52N_2+\text{heat}$$

As can be seen, when air is the source of the oxygen, nitrogen is by far the largest part of the resultant flue gas.

Traditional combustion processes are never perfect or complete. In flue gases from combustion of carbon (as in coal combustion) or carbon compounds (as in combustion of hydrocarbons, wood, etc.) both unburned carbon (as soot) and carbon compounds (CO and others) will be present. Also, when air is the oxidant, some nitrogen will be oxidized to various nitrogen oxides (NOx).

Rapid combustion is a form of combustion in which large amounts of heat and light energy are released, which often results in a fire. This is used in a form of machinery such as internal combustion engines and in turbines. Sometimes, a large volume of gas is liberated in combustion besides the production of heat and light. The sudden evolution of large quantities of gas creates excessive pressure that produces a loud noise known as an explosion.

In complete combustion, the reactant will burn in oxygen, producing a limited number of products. When a hydrocarbon or any carbon based fuel burns in air, the combustion products will also include nitrogen. Complete combustion is the goal, but almost impossible to achieve.

Turbulent combustion is a combustion characterized by turbulent flows. It is the most used for industrial application (e.g. gas turbines, diesel engines, etc.) because the turbulence helps the mixing process between the fuel and oxidizer.

Combustion of a liquid fuel in an oxidizing atmosphere actually happens in the gas phase. It is the vapor that burns, not the liquid. Therefore, a liquid will normally catch fire only above a certain temperature, its flash point. The flash point of a liquid fuel is the lowest temperature at which it can form an ignitable mix with air. It is also the minimum temperature at which there is enough evaporated fuel in the air to start combustion.

The act of combustion of solid fuels consists of three relatively distinct but overlapping phases:

Preheating phase, when the unburned fuel is heated up to its flash point and then at the fire point flammable gases start being evolved in a process similar to dry distillation.

Distillation phase or gaseous phase, when the mix of evolved flammable gases with oxygen is ignited. Energy is produced in the form of heat and light. Flames are often visible. Heat transfer from the combustion to the solid maintains the evolution of flammable vapors.

Charcoal phase or solid phase, when the output of flammable gases from the material is too low for persistent presence of flame and the charred fuel does into burn rapidly anymore but just glows and later only smolders.

To improve combustion, various additives and catalysts have been developed. These typically vary based on the type of fuel, and whether it is a solid or liquid. For example, chemical compositions are added to fuels and lubricants to control the physical and chemical properties of the fuel to improve engine performance. For example, Shields, U.S. Pat. No. 4,340,804, issued Dec. 23, 1980 discloses an additive for hydrocarbon fuels, which are the reaction products of a polyamine and an alkyl ester of acrylic or alkyl acrylic acid particularly suitable for gasoline to reduce the deposition of carbon and other materials in the combustion areas of the engine.

Fuel Cells

Another type of fuel is employed with fuel cells, which extract chemical energy from a mixture to create electricity. A fuel cell creates electricity directly from the energy in chemical fuels without an intermediate conversion into thermal energy. It works similar to a battery. In a battery there are two electrodes separated by an electrolyte. At lease one of the electrodes is generally made of a solid metal, which is converted into another chemical compound during the production of electricity. The electrical energy that a batter can produce in one cycle is limited by the amount of solid metal that can be converted. Conversely, in a fuel cell the solid metal electrodes are replaced by an electrode that is not consumed and a fuel high in ionic radical species that continuously replenishes the fuel cell. This fuel reacts with an oxidant such as oxygen from the other electrode. A fuel cell produces electricity as long as more fuel and oxidant are pumped through it. A typical fuel cell thus reacts oxygen with a fuel to produce electricity and fuel oxide byproducts. The basic core of the fuel cell consists of manifolds, an anode, a cathode, and electrolyte generally called the stack.

Of particular use with the present fuel composition are direct alcohol fuel cells, which have an operated temperature of between 50-100° C., and are particularly suited for powering portable and mobile devices from fuels have many OH groups. Heretofore, these fuel cells typically combine air with alcohol to produce electricity and CO2 byproducts.

Additives

Born et al., U.S. Pat. No. 4,347,062 issued Aug. 31, 1982 discloses a combustion improving additive for liquid fuel consisting essentially of an iron complex soluble in organic media, formed by reacting a sulfonic acid with ferric hydroxide in such proportions as to obtain a ratio of the number of acid gram-equivalents of the sulfonic acid to the number of gram-atoms of the iron in the range from ⅙ to 1/12. The reaction is conducted in the presence of a light aromatic hydrocarbon or a light halogenated aliphatic hydrocarbon having a boiling point from 80 degrees to 230 degree C., and an organic liquid containing oxygen, at least partially miscible with water and substantially miscible with hydrocarbons to produce the iron complex. The iron complex provides a combustion adjuvant for liquid fuels to save energy and reduce pollution.

Brennan et al., U.S. Pat. No. 7,300,477 issued Nov. 27, 2007 discloses another method and fuel additive including iron containing compounds for protecting and improving the operation of diesel fuel combustion systems.

Van den Neste et al., U.S. Pat. No. 6,096,104 issued Aug. 1, 2000 discloses a composition including at least three metals (M1, M2, M3) where the weight ratio of the metal (M3) to metal (M2) is greater than 0.15. The first metal (M1) is selected from the iron group or the manganese group (preferably iron, manganese, cobalt and nickel). The second metal (M2) is selected from the rare earth group (preferably cerium, lanthanum, neodymium and praseodymium). The third metal (M3) is selected from the alkaline or alkaline-earth metal group (preferably barium strontium, calcium and lithium). These mixed organometallic compositions are used as additives to hydrocarbonic liquid fuels to improve combustion. These additives have metallic oxides, which adsorb on asphaltenes and because of their catalytic effect on these asphaltenes they reduce the quantity of solid unburned components released during combustion.

Dodd et al., U.S. Pat. No. 6,663,680 issued Dec. 16, 2003 discloses a fuel which is a hydrocarbon oil-in-water emulsion for gas turbines, which minimizes corrosion of turbine blades by keeping the sodium ion content of the emulsion to less than 1 ppm.

Miyawaki et al., U.S. Pat. No. 4,968,322 issued Nov. 6, 1990 discloses a fuel oil additive with at least two kinds of soaps selected from cerium, neodymium and lanthanum, which are added as combustion promoters for heavy oil, coal slurries, or COM.

Cited for general interest is Michelfelder et al., U.S. Pat. No. 4,461,224 issued Jul. 24, 1984 providing a method of minimizing the emission of contaminants from flame combustion via additives added to the combustion chamber by means of a gaseous and/or liquid carrier flow accompanied by the formation of a veil which surrounds the burner flame. Additional additives are then reacted outside of the combustion chamber.

Despite the wide variety of additives available for fuel applications, there still remains a need for improved additives to provide increased deposit control and more efficient burning.

Catalysts

Haskew, U.S. Pat. No. 6,776,606, issued Aug. 17, 2004, is a recent example of a catalyst composition and method for oxidizing fuels. The catalyst composition comprises at least one compound having one of a group III, group IIA or Lanthanide element such as, for example, Aluminum, Magnesium or Cesium, and at least one compound having at least one element selected from group IA, group IVA, group VI, group VII, group VIII, group IB, group IIB, and combinations thereof, such as, for example platinum, rhodium and rhenium. It thus provides a method for oxidizing a fuel, the method comprising providing a fuel and a catalyst mixture; transporting the fuel and the catalyst to the flame zone separately; mixing the fuel and the catalyst; and oxidizing the fuel. The method and catalyst mixture may be used for oxidation of any hydrocarbon based fuel. Improved results from the use of the group III, group IIA or Lanthanide group elements include increase power, reduced harmful emissions, and smoother oxidation process.

Catalysts are expensive, and often require complex apparatus for proper combustion enhancement.

The fuel additive described below provides a sugar based solution suitable for use with liquid as well as solid carbon based fuels to improve combustion burning. It may be used with or without catalysts, and as a stand alone fuel for fuel cells.

SUMMARY OF THE INVENTION

The present invention comprises a fuel and fuel additive. The fuel and fuel additive composition is derived from:

a. mixing together 1. a given volume of fruit juice containing (x) moles of sugars with low cellulose composition with
2. a dilute volume of hydrogen peroxide containing (y) moles of hydrogen peroxide; the ratio of moles of sugars to moles of hydrogen peroxide (x/y) selected to provide the desired combustion properties of the resultant fuel additive;
3. an iron 2 catalyst which initially turns green in the presence of the hydrogen peroxide solution,
4. sufficient volume of diluted sulfuric acid to turn the green iron 2 catalyst solution to a yellow/brown iron 3 solution at a pH of approximately 5.5; and b. holding the yellow/brown iron 3 solution for 48 hours or more in the dark at a pH of between 5 and 6.5 until the sugars cross link forming numerous OH, O double bonds, and O—R groups to produce a dark brown fuel or fuel additive.

A preferred fuel or fuel additive composition is derived from mixing together a given volume of 15 to 20% sugar content fruit juice containing various moles of sugars with low cellulose composition. To this is added a volume of reactant solution made of 30% by volume of 2% by weight hydrogen peroxide to provide approximately the same number of moles of hydrogen peroxide as the number of moles of sugars in the fruit juice; and 70% by volume of 8% by weight sulfuric acid containing approximate the same number of moles as hydrogen peroxide. Sufficient iron 2 green catalyst is then added until it turns to a yellow/brown iron 3 solution at a pH of approximately 5.5. The reactant solution is cooled sufficiently before addition to the fruit juice to prevent combustion, on mixing. After the reaction occurs, the yellow/brown iron 3 solution is held for 48 hours or more in the dark at a pH of between 5 and 6.5 until the sugars cross link forming numerous OH, O double bonds, and O—R groups to produce a dark brown fuel additive.

The exact volume of the hydrogen peroxide and sulfuric acid is dependent upon the molar sugar composition of the fruit juice, and the desired resultant fuel or fuel additive performance. For example, if all of the sugars in the fruit juice are not reacted, a still powerful fuel additive results. The remaining unreacted sugars contain OH, O double bonds, and O—R groups, which aid in combustion, when ignited to provide a longer more modulated flame.

If the exact volume of reactants to the fruit juice sugar content is required, it may be determined by sugar titration using any of the standard methods, such as the Lane and Eynon method of titration; J. Soc. Chem. Ind., 1923, 43 32 r titration of reducing sugars at the boiling-point with Fehling's solution, where the end point is determined electrometrically or colorimetrically.

The preferred fruit juice is one, which is high in sugars and low in cellulose, such as apples, sugar cane, sugar beets, melons, and other fruits, which also have a low acid content—all of which will be referred to hereafter as "fruit juice". Water is the predominant component of fruit juice. Carbohydrates, including sucrose, fructose, glucose, and sorbitol, are the next most prevalent nutrient in juice. The carbohydrate concentration varies from 11 g/100 mL (0.44 kcal/mL) to more than 16 g/100 mL (0.64 kcal/mL). Fruit juice also contains a small amount of protein and minerals. Fruit juice contains no fat or cholesterol, and unless the pulp is included, it contains no fiber.

The hydrogen peroxide/sulfuric acid solution may be mixed together first before addition to the fruit juice, or its constituents separately added to the fruit juice. For example, in one method, 98.5% by volume fruit juice (having a sugar content of 15 to 20%), with or without pulp, is heated from 110° F. to 160° F. to speed the reaction. Approximately 1% by volume of 2% by weight hydrogen peroxide is then added slowly to the fruit juice. After two or three minutes after the hydrogen peroxide is well mixed into the fruit juice, approximately 0.05% of 8% by weight sulfuric acid is slowly mixed into the hydrogen peroxide fruit mixture and brought to a boil. The iron catalyst is then added and mixed into the solution for three to five minutes until the solution changes to a light yellow brown. This yellow brown solution is then placed in a dark container and allowed to cool for 48 hours or more until a dark brown fuel additive is produced.

If the hydrogen peroxide and sulfuric acid are mixed together in reverse order before addition to the fruit juice, careful handling must be employed to insure heat is dissipated to avoid explosions. This cooled reaction mixture often requires heating after the fruit juice is added to complete the reaction.

The concentration of hydrogen peroxide depends on the molar concentration of the sugars in the fruit juice, and whether a slight surplus is required to provide flash ignition of the fuel additive. Consequently, the molar concentration of the hydrogen peroxide is approximately the same as the molar concentration of the sugars, but may be slightly less if more sugars are required to modulate the flame combustion of the fuel additive, or slightly more if high energy ignition of the fuel additive is required. The fuel additive composition is thus adjusted to meet the combustion needs of a given fuel.

For safety in handling, the percent concentration of hydrogen peroxide is typically diluted to 2% by weight. Similarly, the percent concentration of the sulfuric acid is typically diluted to 8% by weight to control the reactions. In aqueous solution, the hydrogen peroxide can oxidize or reduce a variety of inorganic ions, such as iron. When it acts as a reducing agent, oxygen gas is also produced. In acid solution, the $Fe^{2+}$ is oxidized to $Fe^{3+}$ $$2Fe^{2+}(aq)+H_2O_2+2H^+(aq)\rightarrow 2Fe^{3+}(aq)+2H_2O(l)$$

A good source of iron is ground hematite, but any pulverized oxidized iron source may be used to produce the $Fe^{2+}$ and $Fe^{3+}$ ions required for the sugar reaction.

Because the fuel additive contains O—R groups, it readily penetrates the pores of solid carbon fuels, such as coal, as well as adheres and enwraps liquid carbon fuels, such as vegetable oils, waste motor oils, and other petroleum fuels. This penetration and surface coverage provides extensive fuel surface contact so that when the additive is ignited in the presence of air, almost complete combustion occurs. For example, when used with coal, all that is left is ash containing impurities in the coal.

The fuel and fuel additive is readily storable and has a flashpoint of 2000 degrees F. It also has a long shelf life, and can be admixed with a variety of carbon fuel sources to enhance combustion. However, when combined with fuel, it provides radicals, which excite the flame. It also ignites at approximately 150 to 200 degrees F. and produces an explosive ignition of the fuel, if not modulated. The above chemical components have not previously been combined together for use as a fuel additive as heretofore it has been thought that they were not suitable to produce a synergistic combined action.

The present invention is therefore particularly adapted to provide a combustible surfactant additive, which insures extensive fuel contact exposure to oxidants. Because of the complexities of fruit juice chemical components, and the varieties of fruit juices, the exact molecular composition of the fuel additive may vary. However, the above method produces a fuel additive from all varieties of fruit juices, with some more effective than others.

Alternatively, because of the high number of OH, O double bonds, H+, and O—R radicals, the composition may be used as a fuel for a fuel cell, provided the right electrolyte is selected to separate the anode and cathode. A conductivity test of the fuel performed by Timpview Analytical Laboratories of Orem, Utah showed a reading of 7318 μS/cm, which indicated that the fuel itself has good electrical conductivity properties, and could also act as an electrolyte.

To burn or activate the fuel, optional catalysts may be employed, such as precious metals, including platinum, palladium or ruthenium. Alternatively, a new class of non-precious metal catalysts may be employed, particularly for fuel cells, such as those being developed at Los Alamos National Laboratory. Fuel cells are electrochemical energy conversion devices for the direct conversion of the chemical energy of a fuel into electricity. They are among the key enabling technologies for the transition to a hydrogen-based economy. Of several different types of fuel cells under development, polymer electrolyte fuel cells (PEFCs) have been recognized as a potential future power source for zero emission vehicles. However, to become commercially viable, PEFCs have to overcome the barrier of high catalyst cost caused by the exclusive use of platinum and platinum-based catalysts in the fuel-cell electrodes. A new class of low cost (non-precious metal/heteroatomic polymer) nanocomposite catalysts for the PEFC cathode, capable of combining high oxygen-reduction activity with good performance durability.

The Los Alamos National Laboratory study shows that heteroatomic polymers can be used not only to stabilize the nonprecious metal in the acidic environment of the PEFC cathode but also to generate active sites for oxygen reduction reaction. The class of non-precious cathode catalysts that has attracted the most attention over the years is pyrolized metal porphyrins, with cobalt and iron porphyrins viewed as the most promising precursors.

For flame excitement, catalysts, such as lanthanides, are added so that the fuel releases more thermal energy upon combustion to produce a larger cleaner burning flame. Consequently, the selection of catalysts varies based on cost and the particular applications for which the fuel or fuel additive is employed.

The above description and specification should not be construed as limiting the scope of the invention, but as merely providing illustrations of some of the presently preferred embodiments of the invention. Thus, the scope of the claims recites those features deemed essential to the invention.

We claim:

1. A fuel additive composition for solid and liquid carbon based fuels, said composition produced as follows:

a. mixing together 1. a given volume of fruit juice containing (x) moles of sugars with cellulose composition;

2. a dilute volume of hydrogen peroxide containing (y) moles of hydrogen peroxide; the ratio of moles of sugars to moles of hydrogen peroxide (x/y) selected to provide the desired combustion properties of the resultant fuel additive;
3. an iron 2 catalyst which turns green in the presence of the hydrogen peroxide solution,
4. sufficient volume of diluted sulfuric acid to turn the green iron 2 catalyst solution to a yellow/brown iron 3 solution at a pH of approximately 5.5; and b. holding the yellow/brown iron 2 solution for 48 hours or more in the dark at a pH of between 5 and 6.5 until the sugars cross link forming OH, O double bonds, and carbonyl groups to produce a dark brown fuel additive.

2. A fuel additive composition according to claim 1, wherein the (x/y) ratio is more than one to provide a fuel additive with unreacted sugars, which, when ignited, produces a modulated flame.

3. A fuel additive composition according to claim 1, wherein the (x/y) ratio is less than one to provide a fuel additive with unreacted hydrogen peroxide, which, when ignited, produces flash ignition.

4. A fuel additive composition according to claim 1, wherein the (x/y) ratio is approximately one to provide a fuel additive with reacted hydrogen peroxide and sugars.

5. A fuel additive composition according to claim 1, wherein the fruit juice has 15 to 20% sugar content.

6. A fuel additive composition according to claim 1, wherein the hydrogen peroxide solution is mixed with the iron 2 green catalyst and sufficient sulfuric acid to form a yellow/brown iron 3 reactant solution, which, is then added to the fruit juice for reaction.

* * * * *